US005487723A

United States Patent [19]

Ito

[11] Patent Number: 5,487,723

[45] Date of Patent: Jan. 30, 1996

[54] MULTI-DIRECTIONAL ROLLING MASSAGER

[76] Inventor: Takakazu Ito, 1-866, Kami Higashiozone-cho, Kita-Ku, Nagoya, Japan

[21] Appl. No.: 175,925

[22] Filed: Dec. 30, 1993

[51] Int. Cl.[6] ..... A61H 15/00

[52] U.S. Cl. ..... 601/99; 601/102; 601/116

[58] Field of Search ..... 601/86, 98, 99, 601/102, 115–117, 50–52, 84–86, 97–99, 115–117, 102; 15/21.1

[56] References Cited

U.S. PATENT DOCUMENTS

| | | | |
|---|---|---|---|
| 2,395,040 | 2/1946 | Curtis | 601/99 |
| 3,043,293 | 7/1962 | Rider | 601/86 |
| 4,422,449 | 12/1983 | Hamabe | 601/99 |
| 4,574,786 | 3/1986 | Hashimoto et al. | 601/99 |
| 4,576,149 | 3/1986 | Otuka et al. | 601/99 |
| 4,744,350 | 5/1988 | Sato | 601/15 X |
| 4,875,470 | 10/1989 | Cotone | 601/117 |
| 5,020,518 | 6/1991 | Spears et al. | 601/116 |
| 5,022,386 | 6/1991 | Kuniskis | 601/117 |
| 5,137,016 | 8/1992 | Yanasaki et al. | 601/116 |
| 5,186,424 | 2/1993 | Shultz et al. | 601/86 X |
| 5,233,973 | 8/1993 | Gill et al. | 601/99 X |
| 5,271,386 | 12/1993 | Thompson | 601/102 |

*Primary Examiner*—Robert A. Hafer
*Assistant Examiner*—Brian E. Hanlon
*Attorney, Agent, or Firm*—Emmanuel J. Lobato

[57] ABSTRACT

A massager for incorporation internally of a seat, and the seat, which may be reclinable, either in a seat portion thereof or a backrest or in both the seat portion and backrest for massaging an occupant seated or reclining on the seat. The massager has a pair of rotatable massage rollers extending longitudinally in opposite directions on a common longitudinal axis and are transported on a self-propelled carriage which travels alternately on two rectilinear paths in the form of parallel tracks. The carriage carries a pivot normal to the longitudinal axis of the massage rollers about which the longitudinal axis is selectively rotated by an electric motor so that the massage rollers are rotated in a circular path for massage different body parts of the seat occupant than when travelling on the rectilinear paths. A switch drum rotated by an electric motor and belt drive carries the carriage on a pair of parallel switch tracks alignable with the linear tracks for switching to alternate travel of the carriage on the rectilinear tracks. A control system of switches activated by the carriage energizes various electric motors in timed relationship for sequencing the travel of the carriage for massaging the hips and/or back of the occupant of the seat.

17 Claims, 7 Drawing Sheets

MULTI-DIRECTIONAL ROLLING MASSAGER

BACKGROUND OF THE INVENTION

1. Field of the Invention

The present invention relates to a massager adapted to massage back and/or hips of a user sitting on a chair or seat or lying on a reclinable chair similarly to lying on a mat by massage rollers incorporated in the chair or reclinable chair referred to hereinaftere as a mat so as to roll on the back and/or hips, respectively, exerting appropriate massage pressure thereupon.

2. Description of the Prior Art

A massager is well known which contains within back and/or seat of a chair rollable rollers so as to massage the back and/or hips of a user.

However, with the massager of the prior art, the rollers are reciprocated in a single direction and substantially a limited area is massaged in a fixed direction. Accordingly, the user must frequently shift his or her body position in order that entire extents of the backs and/or the hips are massaged. It has been found that the affected part of user's body is inevitably not massaged.

SUMMARY OF THE INVENTION

The massager of the present invention has been developed in view of the problem mentioned above. The invention comprises pressure rollers driven by electric motors for rectilinear reciprocating motion along one of two directions at a time, these two directions being substantially orthogonal to each other, as well as for circular motion, over surfaces or the chair or the mat destined to bear against the back and/or the hips, respectively, of a user.

The invention is based on the arrangement wherein there are provided a pair of rollers symmetrically with respect to a support for these rollers so that these rollers make rectilinear reciprocating motion together with the support as well as the circular motion around the support.

The invention is based on an arrangement the rollers are magnetic rollers.

The invention is advantageous in that the user can be effectively massaged by the rollers in different directions over wide extents of body parts while the user sits on a chair or lies on a mat in a fixed posture, since the rollers move on the back and the hips of the user longitudinally as well as transversely and additionally move along a circular track, exerting appropriate pressure on these body parts.

Obviously, the user may shift his or her position on the chair or the mat to increase the extent over which the user's body can be massaged.

The invention is advantageous in that paired provision of rollers contributes to achieve an efficient and well balanced massage.

The invention is advantageous in that a magnetic force is combined with the pressure exerted by the rollers to further increase the massaging effect.

DESCRIPTION OF THE PREFERRED EMBODIMENT

The invention will be more readily understood from the following detailed description of a specific embodiment as applied to a legless chair made in reference with the accompanying drawings.

Figure 1:
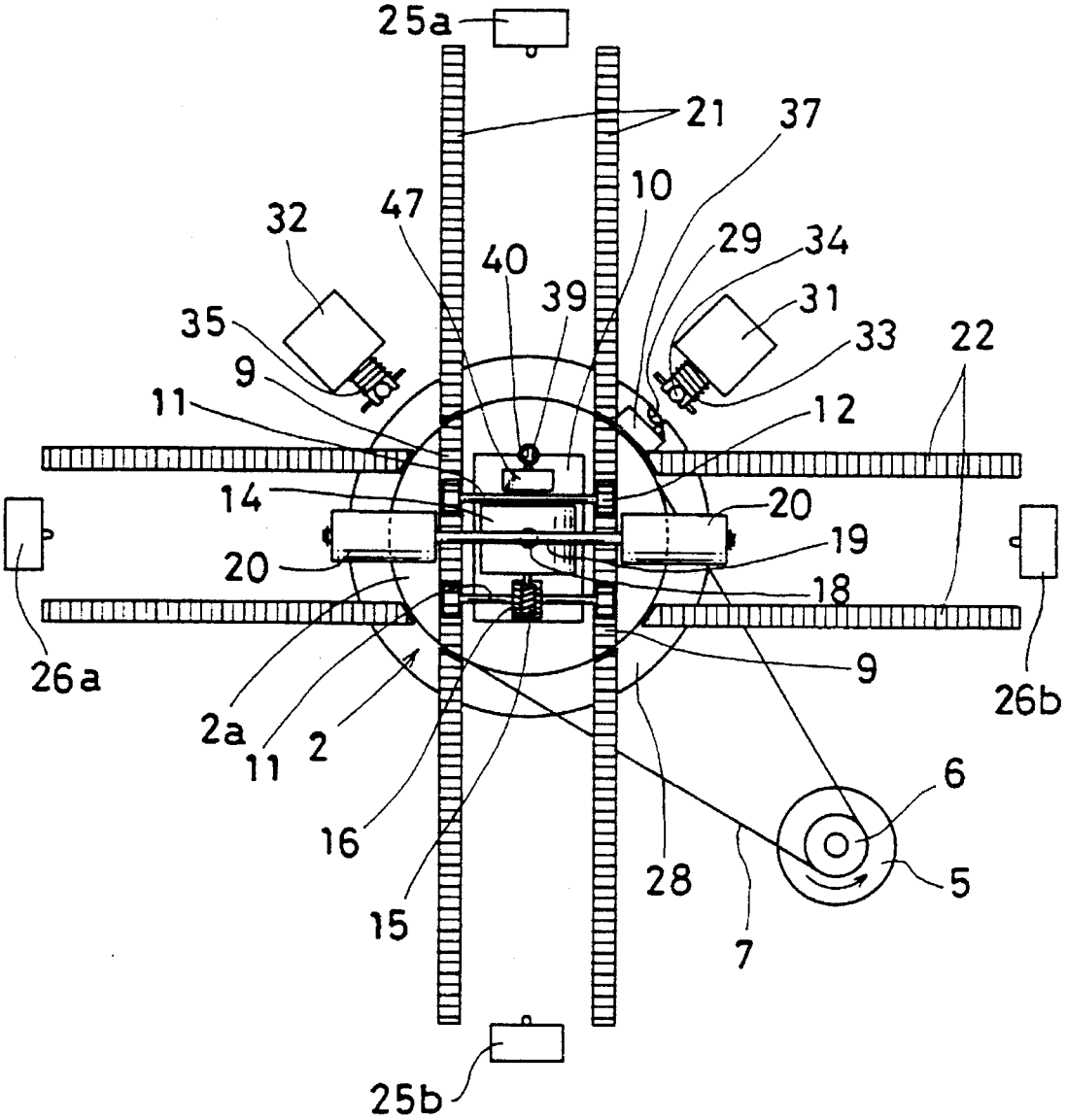
FIG. 1 is a plan view showing of an embodiment of the invention.
Figure 2:
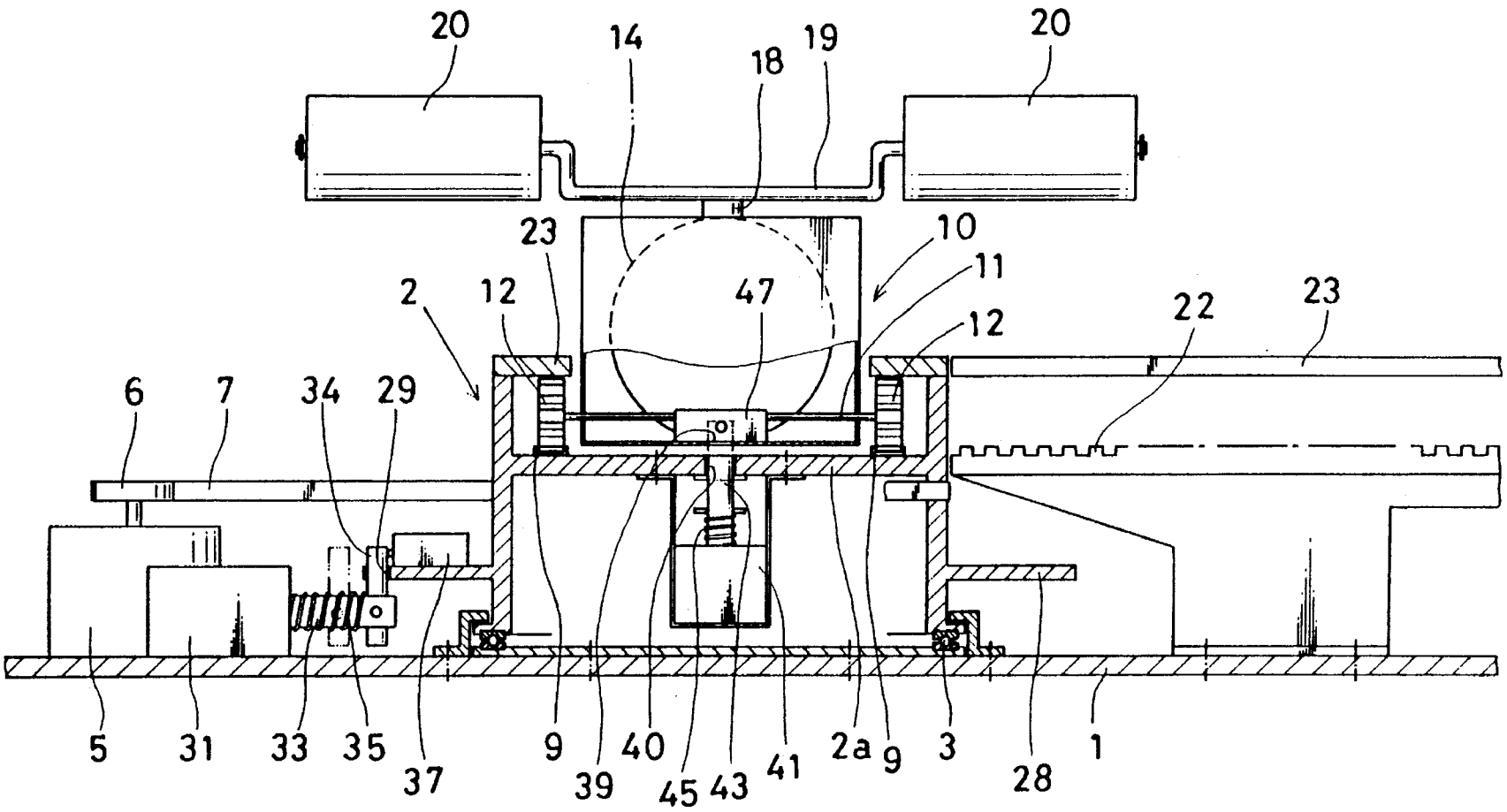
FIG. 2 is a sectional view partially showing, in enlarged scale, the embodiment in FIG. 1.

Referring to FIGS. 1 and 2, a drum 2 is rotatably supported by bearings 3 centrally on a base plate 1 and rotationally driven, counterclockwise as seen in FIG. 1, by a first electric motor 5 via a belt 7 about the outer periphery of the drum 2, on one side, and around a roller 6 fixed on an output shaft of said first electric motor 5.

A pair of switching rails 9 extending in parallel to each other with a rotation center of the drum 2 between on top plate 2*a* of the drum 2 for track switching and a self-propelled vehicle or carriage 10 is disposed on the switching rails 9.

Front and rear axles 11 of the vehicle 10 are provided on their opposite ends with wheels 12 in the form of pinions adapted to be engaged with respective switching rails 9 in the form of racks and a worm 15 fixed on an output shaft of a reversible second electric motor 14 contained in the vehicle 10 is engaged with a worm wheel 16 fixed on a driving axle 11 so that the vehicle 10 is self-propelled forward or backward along the switching rails 9 depending on forward or reverse rotation of the second electric motor 14.

An arm 19 is fixed at its longitudinally middle on a support 18 which is, in turn, provided upright on top of the vehicle 10 and rotatably carries a pair of rollers 20 on opposite ends, respectively.

First travelling rails 21 and second travelling rails 22 extend orthogonally to each other in front and behind, as well as on right and left sides with respect to the drum 2 and also provided in the form of rocks so that these travelling rails 21, 22 can be aligned and continuous with the switching rails 9.

Above these travelling rails 21, 22 and the switching rails 9, there are provided guard plates 23 serving to prevent the wheels 12 from derailing off these rails.

At opposite ends of the respective travelling rails 21, 22 there are provided a pair of switches 25*a*, 25*b* and a second pair of switches 26*a*, 26*b*, respectively, in order to detect when a front or rear side of the vehicle 10 reaches associated one of the track ends and runs against the associated one of these switches.

The outer periphery of the drum 2 is provided adjacent its lower end with a flange 28 which is, in turn, provided on a given position of its outer periphery with a first positioning notch 29 serving for angularly positioning the drum 2. Outside the flange 28, there are provided a first solenoid 31 and a second solenoid 32 at an angular distance of 90° from each other.

A plunger 33 of each solenoid 31, 32 carries on its forward end a vertically directed rod 34 adapted to enter said first positioning notch 29 and, when the solenoid is not excited, the plunger 33 is urged by a biasing spring 35 so that the rod 34 is urged against the outer periphery of the flange 28 as indicated by a solid line in FIG. 2 and, when the solenoid is excited, the plunger 33 is retracted against the biasing effect of the spring 35 so that the rod 34 is retracted off the outer periphery of the flange 28.

Respective solenoids 31, 32 are located so that, when the first positioning notch 29 is opposed to the first solenoid 31, the drum 2 takes its angular position so as to align the switching rails 9 with the longitudinal first travelling rails 21 and, when the first positioning notch 29 is opposed to the second solenoid 32, the drum 2 takes its angular position so as to align the switching rails 9 with the transverse second travelling rails 21.

The first positioning notch 29 of the flange 28 contains a third switch 37 to detect when the rod 34 of the solenoid 31 or 32 enters the first positioning notch 29.

The front side of the vehicle 10 is provided centrally on its lower edge with a second positioning notch 39 serving to position the vehicle 10 diametrically of the drum 2. The top plate 2a of the drum 2 is provided at a given position with a through-hole 40 just above the center line of the switching mils 9 and a third solenoid 31 is mounted by a bracket below the through-hole 40 so as to be directed upward.

When the third solenoid 41 is not excited, a forward end of its plunger 43 urged by the biasing force of a spring 45 to extend upward through and beyond the through-hole 40 as indicated by a broken line in FIG. 2 and to enter the second positioning notch 39 and, upon excitation, the forward end of the plunger 43 is retracted within the through-hole 40.

When the plunger 43 of the third solenoid 41 enters the second positioning notch 39, the vehicle 10 takes a position at which the support 18 carrying the rollers 20 aligned with the rotation center of the dram 2.

Behind the second positioning notch 39, tile vehicle 10 has a fourth switch 47 serving to detect when the plunger 43 of the third solenoid 41 enters the second positioning notch 39.

Figure 8:
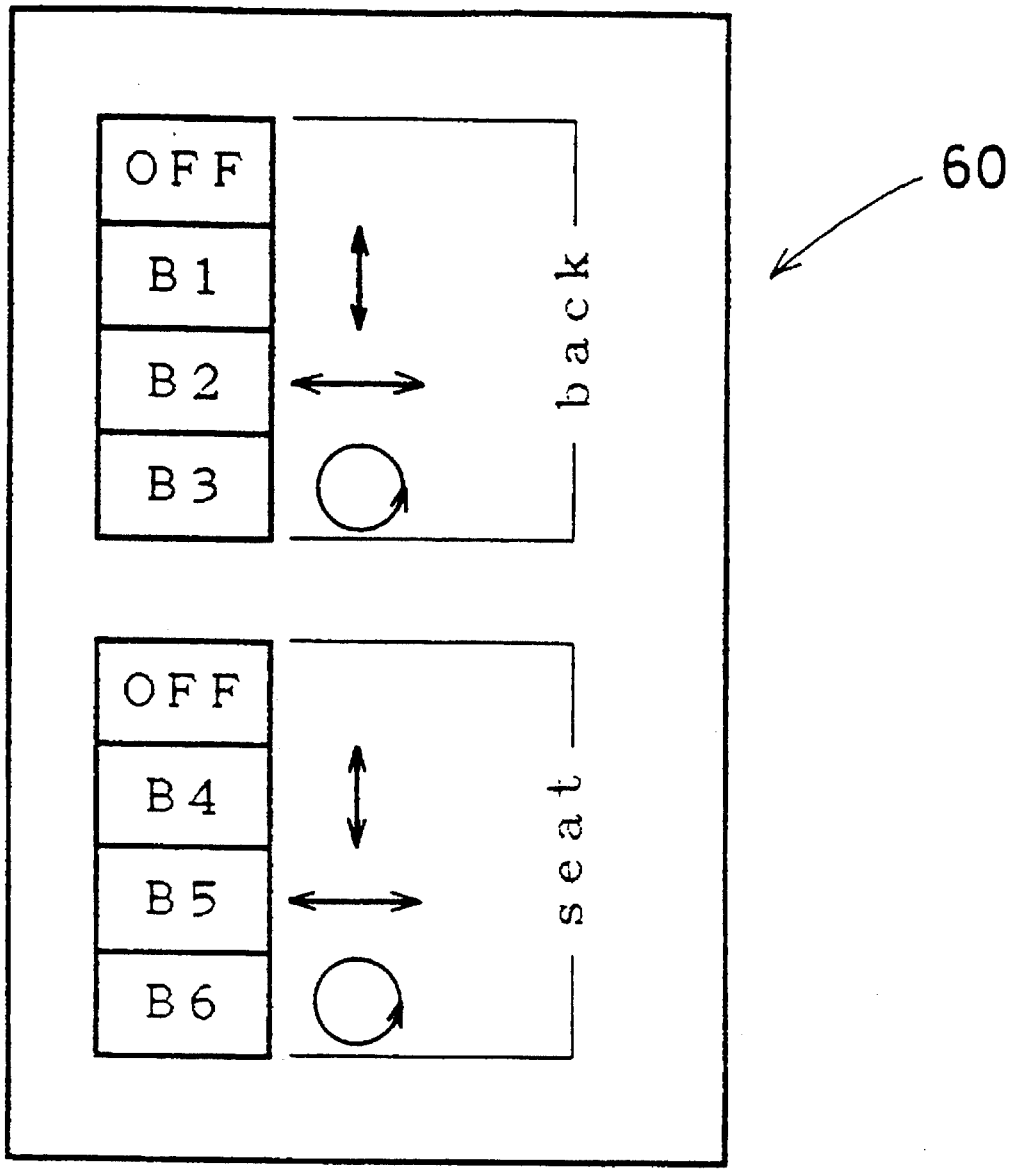
FIG. 8 is a plan view of the control panel.

The above-mentioned components, i.e., electric motors 5, 14, solenoids 31, 32, 41 and switches 25, 26, 37, 47 are electrically connected to a controller (not shown) and operate according to a predetermined program in response to a user's operation on a control panel 60 as shown by FIG. 8.

Figure 3:
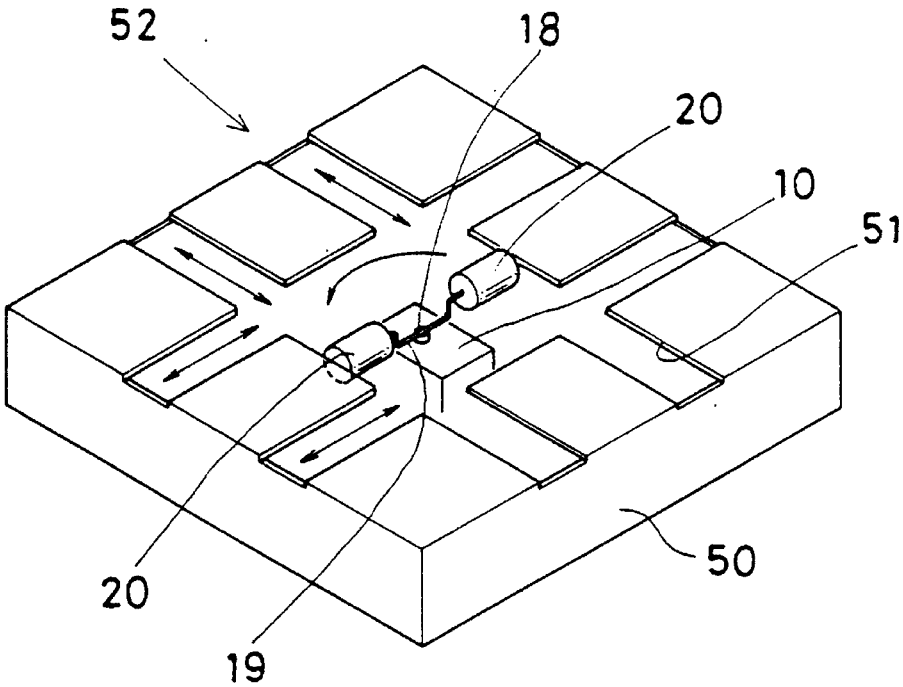
FIG. 3 is a perspective view showing outer appearance of a unit of the embodiment.
Figure 4:
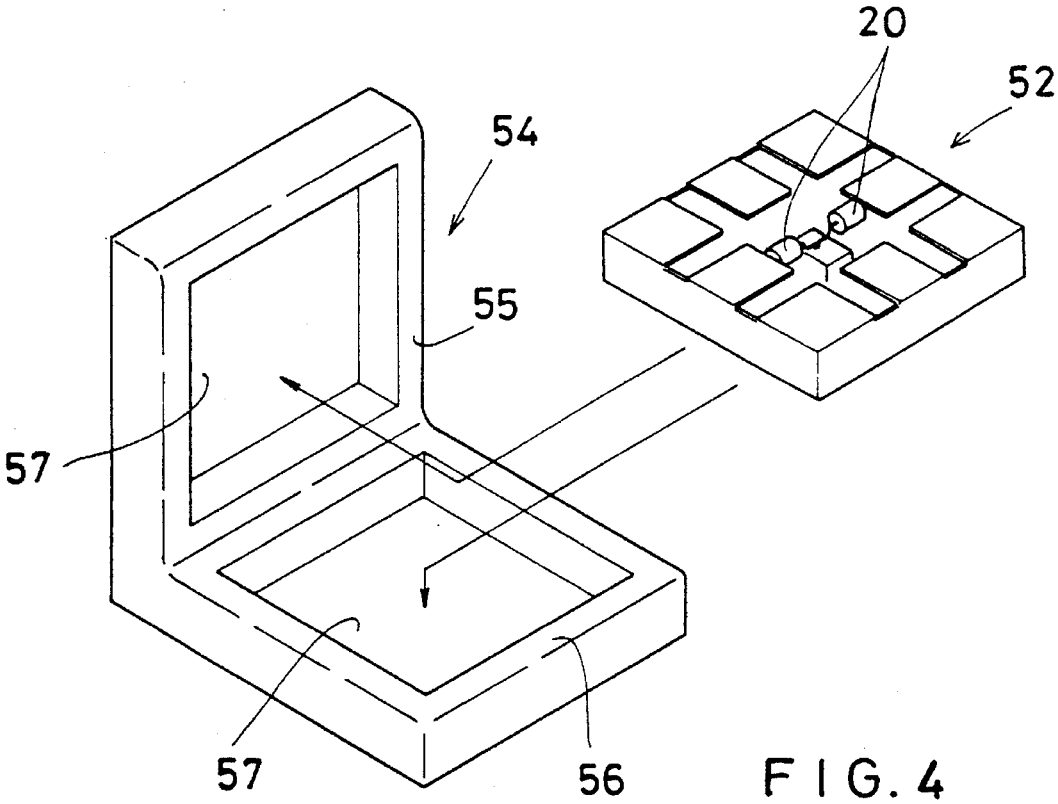
FIG. 4 is a diagram illustrating how to install unit in a chair.

There components shown by FIGS. 1 and 2 are housed in a box or enclosure 50 so as to form a unit 52. The box 50 is formed in its top side with an opening, as shown by FIG. 3, allowing the rollers 20, which have circumferential surfaces that partially project above said top side, to travel in the predetermined different directions.

The unit 52 is adapted to be received by a recess 57 formed in a back 55 or a seat 56 of a legless chair 54.

A manner in which the embodiment of such arrangement operates will be now described.

Figure 5:
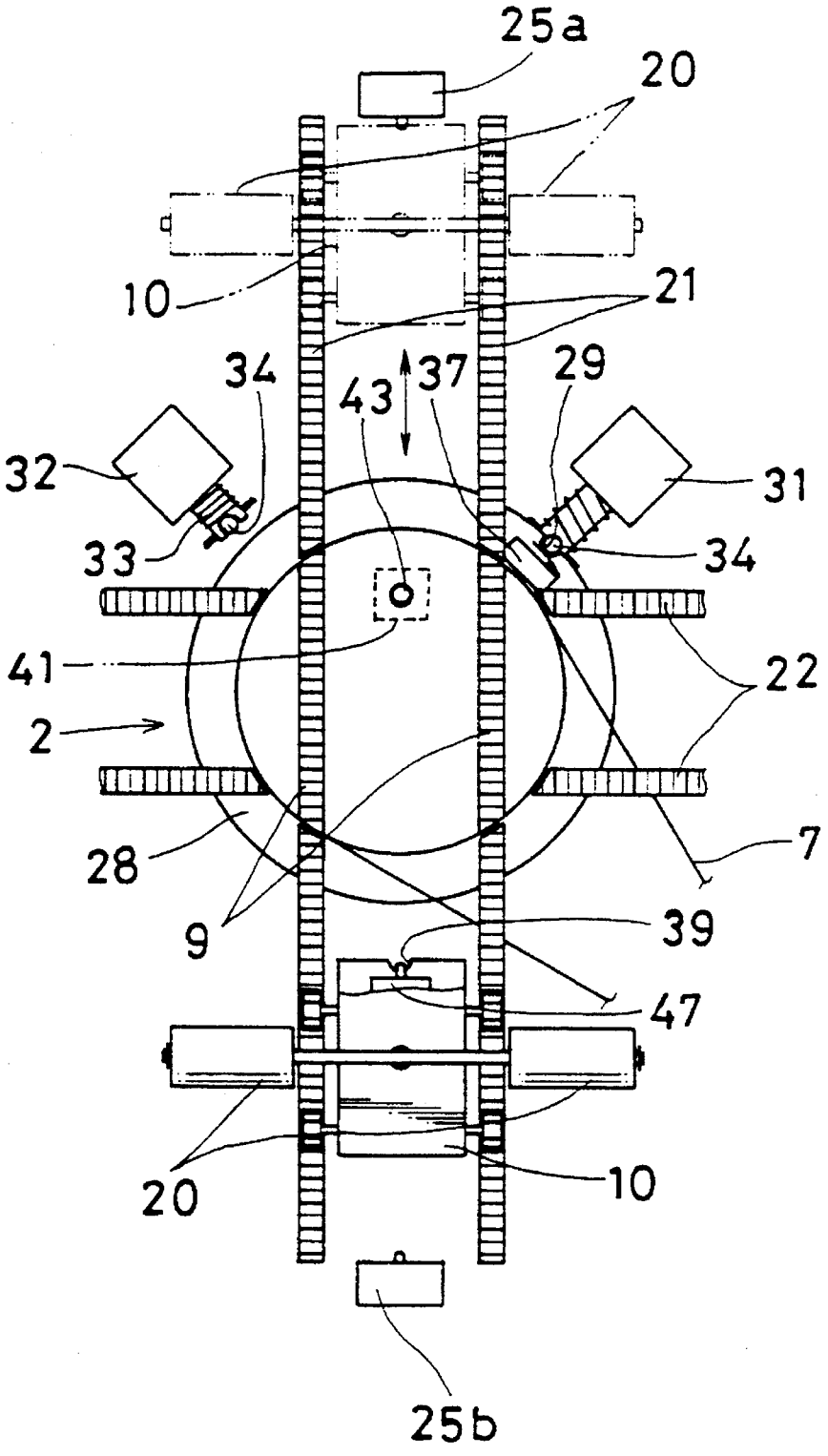
FIG. 5 is a diagram illustrating a manner in which the rollers move longitudinally.
Figure 6:
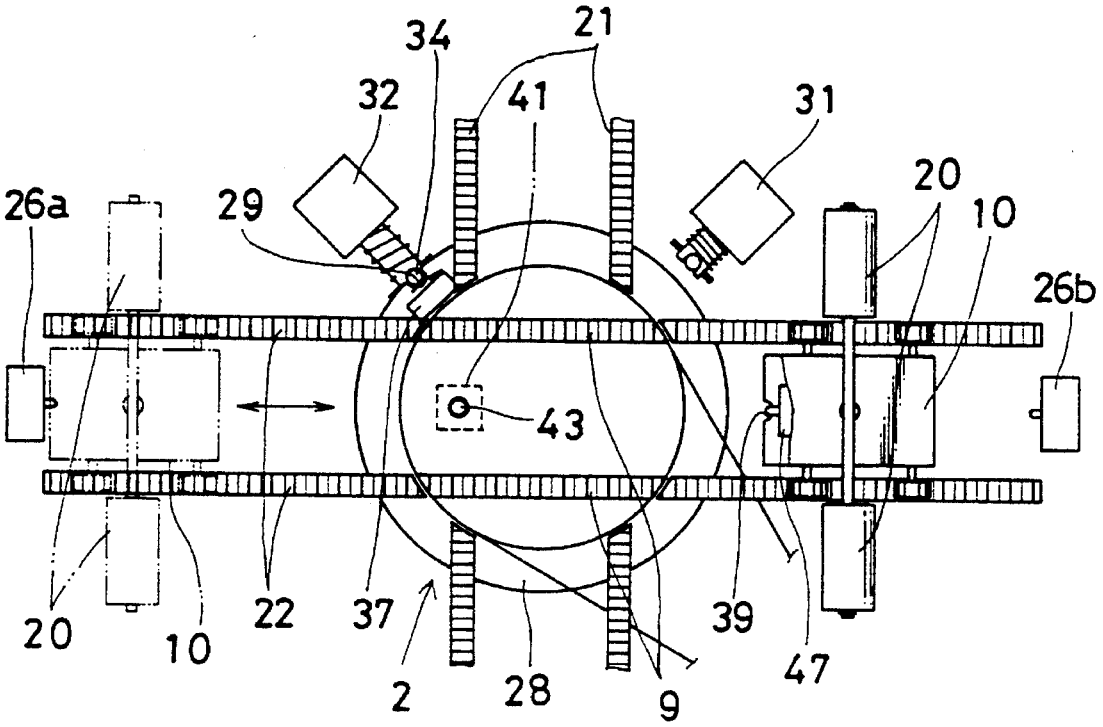
FIG. 6 is a diagram illustrating a manner in which the rollers move traversely.
Figure 7:
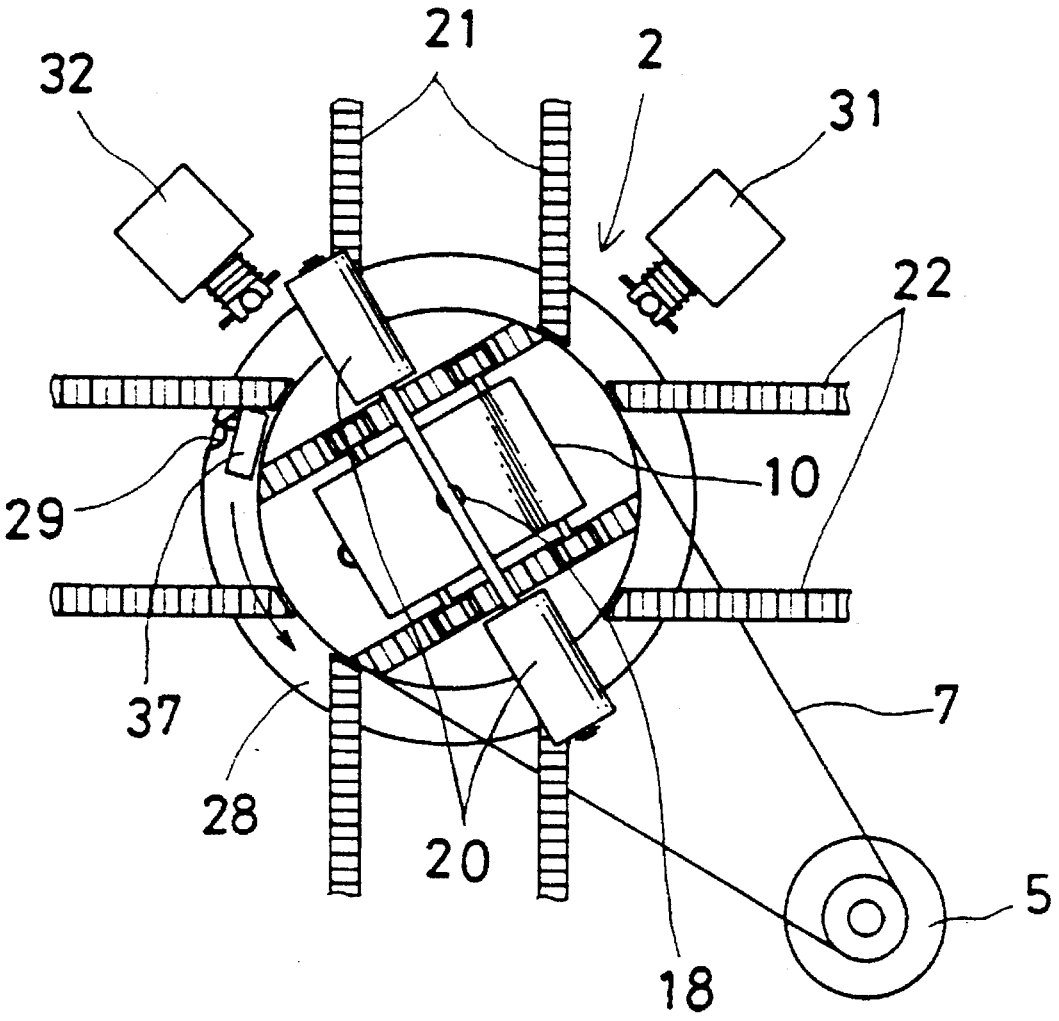
FIG. 7 is a diagram illustrating a manner in which the rollers make a circular motion.

Description will begin with a case in which the rollers 20 are reciprocated longitudinally of the massagcr. Upon depression of button B1 or B4 on the control panel 60 provided to drive the rollers 20 longitudinally of the massager, the first solenoid 31 is deenergized and the rod 34 enters the first positioning notch 29 formed in the periphery of the flange 28 of the drum 2 so as to align the switching mils 9 on the drum 2 with the first travelling rails 21, as shown by FIG. 5. The second solenoid 32 and the third solenoid 41 are excited and correspondingly the plungers 33, 43 are retracted.

From this state, the second electric motor 14 provided within the vehicle 10 is rotated forward to drive the vehicle 10 forward along the first travelling rails 21 and when the vehicle 10 hits against and turns the fi-ont first switch 25*a* ON, as indicated by chain or broken line in FIG. 5, the second electric motor 14 is reversed to drive the vehicle 10 backward along the first travelling rails 21 by way of the switching rails 9 and hits against and turns the rear first switch 25*b* ON, whereupon the second electric motor 14 is rotated again forward to drive the vehicle 10 forward. Repetition of such switching operation allows the rollers 20 to make a reciprocating motion longitudinally of the massager.

Then button B2 or B5 on the control panel 60 provided to drive the vehicle 10 transversely of the massager is depressed. After depression of the button B2 or B5, the third solenoid 41 is dccnergized and the forward end of the plunger 43 projects above the top plate 2*a* of the drum 2 as indicated by a broken line in FIG. 2 synchronously when the rear first switch 25*b* is turned ON during movement of the vehicle 10 in the longitudinal direction and thereby the vehicle 10 is switched to travel forward.

Thereupon, the second positioning notch 39 provided in front side of the vehicle 10 which is travelling forward on the switching rails 9 receives the projecting end of the third solenoid's plunger 43 and thercby the fourth switch 47 is turned ON. Thus the second electric motor 14 is aleenergized and the vehicle 10 is stopped. At this moment, the vehicle 10 occupies a position at which the support 18 for the rollers 20 is aligned with the rotation center of the drum 2.

Then the first solenoid 31 is excited and the rod 34 is retracted from the first positioning notch 29 formed in the periphcry of the flange 28 of the drum 2 while the second solenoid 32 is deenergized and the plunger 33 projects so that the rod 34 is pressed against the outer periphery of the flange 28.

The first electric motor 5 is thereby energized to rotate the drum 2 counterclockwise and, after rotation of the drum 2 by an angle of 90°, the first positioning notch 29 is disposed to the second solenoid 32 and the rod 34 enters therein to turn the third switch 37 ON.

As a consequence, the first electric motor 5 is deenergized and the drum 2 is held at an angular position with the switching rails 9 aligned with the second travelling rails 22. Therealter, tile third solenoid 41 is excited and the plunger 43 is retracted frown the second positioning notch 39 into the through-hole 40 extending through the top plate 2*a* of the drum 2.

Now the second electric motor 14 contained within the vehicle 10 is energized and switched betwecn a forward and a reverse driving modes as the second switches 26*a*, 26*b* on both sides are altcrnately turned ON as in the same manner as has been described above. In this way, the vehiclc 10 and the rollers 20 make a reciprocating motion along the second travelling rails 22, i.e., transversely of the massager.

Now button B3 or B6 on the control panel 60 provided to drive the vehicle 10 along a circular track is depressed. After depression of the button B3 or B6, the third solenoid 41 is deenergized and the plunger 43 projects above the top plate 2*a* of the drum 2 synchronously when the right second switch 26*b* is turned ON during movement of the vehicle 10 in the transverse direction and thereby the vehicle 10 is switched to travel leftward. During travelling of the vehicle 10 along the switching rails 9 leftward, the projecting end of the plunger enteres the second positioning notch 39 and thereby the fourth switch 47 is turned ON. The second electric motor 14 is thereby deenergized and the vehicle 10 is stopped. At this moment, the vehicle 10 occupies a position at which the support 18 of the rollers 20 is aligned with the rotation center of the drum 2.

Simultaneously, the second solenoid is excited and the rod 34 is retracted from the first positioning notch 29 of the flange 28 so that the drum 2 becomes rotatable. Then the first electric motor 5 is energized so that the drum 2 is rotated together with the vehicle 10 placed thereon and the rollers 20 roll on a circular path defined with a predetermined radius around the support 18.

It should be understood that a sequence of switching the direction in which the rollers 20 roll is not limited to the above-mentioned sequence ordered in longitudinal, transverse and circular movements. It should be also understood that the rollers 20 in the back 55 and the sear 56 of the legless chair may move in a corresponding manner or independent manner.

As will be appreciated from the foregoing description, the embodiment illustrated allows the rollers 20 to move on the back and the hips of a user longitudinally as well as transversely and additionally to move along a predetermined circular track, exerting appropriate pressure on these body parts. Accordingly, the user can be effectively massaged by the rollers 20 in different directions over wide extents of the body parts while the user sits on the legless chair 54 in a fixed posture. Obviously, the user may shift his or her position the chair or the mat to increase the extent over which the user's body can be massaged.

Paired provision of the rollers 20 allows the massage to be efficient and well balanced. Magnetic rollers may be employed as the rollers 20 to enhance a massaging effect since a magnetic force is combined with the pressure exerted by the rollers 20.

The unit 52 may be incorporated in one of the back rest 55 and the seat 56 of the legless chair 54 or both of them. The unit 54 is applicable also to an ordinary chair.

Furthermore, by arranging the legless chair 54 as so-called reclining chair, the chair can be used as a mat and thereby the user can be massaged on the back and/or the hips while lying on this mat converted from the legless chair 54. It will be also possible to incorporate the unit 52 in a non-convertible mat at positions corresponding to the back and/or the hips.

I claim:

1. A massager for incorporation into a seat comprising:

a selectively rotatable switch drum having a pair of switch tracks on opposite sides of a center of rotation of said rotatable wwitch drum;

pairs of parallel travel tracks on a same plane with the switch tracks extending radially from said switch drum at ninety degrees angular intervals whereby pairs of said travel tracks extend diametrically in opposite directions from said center of rotation;

a self-propelled carriage having wheels and an electric drive motor for travel from said switch tracks and onto said travel tracks;

means for selectively rotating said switch drum in rotational angular intervals for aligning the switch tracks with diametrically disposed pairs of said parallel travel tracks for travel of said carriage thereon back and forth in opposite directions along paths orthogonal to each other;

said carriage having two rotatable massage rollers disposed extending in opposite directions laterally of said carriage and transported thereon during travel;

means comprising electrical means having controls for sequencing in timed relationship rotation of said switch drum and energizing of said electric motor for effecting travel of said carriage along said paths alternately and back and forth in opposite directions thereon for said massage rollers to massage body parts of a user during travel of said carriage on said travel tracks; and an enclosure enclosing said massager as a unit with said massage rollers disposed with surfaces which partially project from a side of said enclosure to massage the body parts of a user.

2. A massager for incorporation into a seat acording to claim 1, in which said carriage wheels are pinions, and said switch tracks and travel tracks are racks on which the pinion wheels travel.

3. A massager for incorporation into a seat according to claim 1, including guards disposed extending along said switch tracks and travel tracks to preclude derailment of said carriage during travel thereof.

4. A massager for incorporation into a seat according to claim 1, in which said massage rollers are solid and made of a magnetic material.

5. A massager for incorporation into a seat according to claim 1, including an electric motor for driving the carriage reciprocally when on said travel tracks whereby the massage rollers are reciprocally transported for massaging a body part of the user.

6. A massager for incorporation into a seat according to claim 1, in which said massage rollers extend in opposite directions in a same plane transversely of the travel tracks.

7. A massager for incorporation into a seat according to claim 1, including means for selectively holding said switch drum at different angular positions for selected periods of time for positioning said switch tracks in registry with the travel tracks to provide switch connections between the switch tracks and travel tracks for said carriage to travel on said travel tracks including travel transversely of said switch drum.

8. A massager for incorporation into a seat according to claim 1, in which said massage rollers are made of a magnetic material.

9. A massager for incorporation internally of a seat having a flexible cover material such as a reclinable chair for massaging back and hip body parts of an occupant in a seated position or lying on a reclinable seat comprising:

an enclosure enclosing said massager for mounting the massager as a unit in first portion of said chair or in combination with an identical massager mounted in a second portion of siad chair;

a pair of rotatable coaxial elongated massage rollers extending longitudinally in a common plane and having circumferential surfaces extending partially outwardly of said enclosure for underlying an occupant in a seated position on said seat or in a reclined position in a reclinable seat;

means defining two pairs of rectilinear travel paths, each pair of said travel paths being Orthogonal to the other pair;

a self-propelled carriage carrying said massage rollers rectilinearly alternately along the two pairs of rectilinear, orthogonal travel paths and back and forth thereon with said massage rollers extending longitudinally on a longitudinal axis in opposite directions transversely of the individual rectilinear travel paths when transported therealong;

switch means having an electric motor for semiautomatically switching the carriage alternatively to said two pairs of rectilinear travel paths for travel therealong for massaging different body parts of said occupant;

means for selectively rotating the massage rollers about a pivot axis normal to said longitudinal axis for travel along a circular path for massaging different body parts of said occupant of the seat than when the carriage travels along said rectilinear travel paths;

an electric motor selectively energized for driving said self-proposed carriage along said orthogonal rectilinear travel paths, and wherein said means for selectively rotating the massage rollers includes an electric motor selectively energized for rotating said massage rollers about said pivot axis; and means for selectively electrically energizing each electric motor in a predetermined sequence in timed relationship.

10. A seat having a seat portion and a backrest comprising:

a first massager disposed internally of said seat portion for massaging body parts of an occupant of said seat;

a second massager the same as the first massager disposed internally of said backrest for massaging other body parts of said occupant independently of said first massager;

each said first massager and second massager comprising:

a pair of rotatable elongated massage rollers coaxially disposed and extending longitudinally in opposite directions on a common longitudinal axis of rotation;

means defining two pairs of rectilinear travel paths, each pair of said travel paths being orthogonal to the other pair;

a self-propelled electrically driven carriage transporting said two massage rollers back and forth along said two pairs of rectilinear travel paths orthogonal to each other;

means on said carriage comprising a pivot normal to the longitudinal axis of the massage rollers for selectively rotating the massage rollers in a circular path about said pivot for massaging different body parts of the seat occupant;

switch means having an electric motor for selectively switching the carriage for travel alternately on the two pairs of of rectilinear travel paths;

an electric motor for driving said self-propelled carriage;

an electric motor on said carriage for selectively rotating the massage rollers about said pivot for travel thereof in said circular path; and means for controlling energizing of each electric motor in timed relationship for effecting massaging of body parts of said occupant of said seat.

11. A seat according to claim 10, including an enclosure for each massager mounting each massager internally of said seat as an unit.

12. A seat according to claim 10, in which each massage roller is made of a magnetic material.

13. A seat according to claim 10, in which each said pair of rectilinear paths comprises a pair of parallel tracks.

14. A seat according to claim 13, in which said switch means comprises a pair of parallel switch tracks selectively aligned with said parallel tracks of a rectilinear path for alternate travel of said carriage on said rectilinear paths.

15. A seat according to claim 12, in which said seat is a legless seat.

16. A seat according to claim 10, in which the two pairs of orthogonal paths comprise pairs of parallel tracks disposed about a switch intersection, at ninety degree intervals, and said switch means comprises a selectively rotated drum disposed at said switch intersection and having a pair of switch tracks thereon alignable with individual pairs of said parallel tracks for said carriage to switch alternately to said rectilinear travel paths.

17. A seat according to claim 16, in which said pairs of tracks each comprises parallel gear racks and said switch tracks comprise a pair of parallel gear racks, and said carriage having pinions for travelling on the gear racks.

* * * * *